US009810073B2

(12) United States Patent
Jung

(10) Patent No.: US 9,810,073 B2
(45) Date of Patent: Nov. 7, 2017

(54) TURBINE BLADE HAVING SWIRLING COOLING CHANNEL AND COOLING METHOD THEREOF

(71) Applicant: DOOSAN HEAVY INDUSTRIES & CONSTRUCTION CO., LTD., Gyeongsangnam-do (KR)

(72) Inventor: Sung Chul Jung, Daejeon (KR)

(73) Assignee: DOOSAN HEAVY INDUSTRIES & CONSTRUCTION Co., LTD, Gyeongsangnam-do (KR)

( * ) Notice: Subject to any disclaimer, the term of this patent is extended or adjusted under 35 U.S.C. 154(b) by 375 days.

(21) Appl. No.: 14/570,639

(22) Filed: Dec. 15, 2014

(65) Prior Publication Data

US 2015/0198049 A1 Jul. 16, 2015

(51) Int. Cl.
*F01D 5/18* (2006.01)

(52) U.S. Cl.
CPC ..... *F01D 5/187* (2013.01); *F01D 5/186* (2013.01); *F05D 2260/2212* (2013.01)

(58) Field of Classification Search
CPC . F01D 5/186; F01D 5/187; F01D 5/18; F05D 2260/14; F05D 2260/202; F05D 2260/22141; F05D 2260/2212
See application file for complete search history.

(56) References Cited

U.S. PATENT DOCUMENTS 3,738,771 A * 6/1973 Delarbre ..... F01D 5/181 165/104.25
5,002,460 A * 3/1991 Lee ..... F01D 5/188 415/115
5,993,156 A * 11/1999 Bailly ..... F01D 5/187 415/115
6,974,306 B2 * 12/2005 Djeridane ..... F01D 5/3007 416/1
7,413,406 B2 8/2008 Pietraszkiewicz et al.
7,665,965 B1 * 2/2010 Liang ..... F01D 5/18 416/1
7,824,156 B2 * 11/2010 Dellmann ..... F01D 5/187 416/96 R
2006/0120868 A1 * 6/2006 Dorling ..... F01D 5/187 416/97 R
2006/0153679 A1 7/2006 Liang
2007/0014664 A1 1/2007 Dellmann et al.
(Continued)

FOREIGN PATENT DOCUMENTS

CN 1727643 A 2/2006
DE 102013011350 A1 * 1/2015 ..... F01D 25/12
(Continued)

OTHER PUBLICATIONS

DE 102013011350 A1 (English Translation).*
(Continued)

*Primary Examiner* — Richard Edgar
(74) *Attorney, Agent, or Firm* — Baker & McKenzie LLP

(57) ABSTRACT

A turbine blade includes a cooling channel through which cooling air is passed, and a swirl portion provided at an entrance of the cooling channel so as to form a swirl flow in the cooling air. The turbine blade may increase cooling performance of a root unit, improve the stiffness of the root unit, and increase the internal heat transfer efficiency of a blade unit.

20 Claims, 8 Drawing Sheets

(56) References Cited

U.S. PATENT DOCUMENTS

| | | | | |
|---|---|---|---|---|
| 2012/0171046 | A1* | 7/2012 | Boyer | F01D 5/081<br>416/97 R |
| 2013/0243575 | A1 | 9/2013 | Zelesky et al. | |
| 2013/0343872 | A1* | 12/2013 | Tibbott | F01D 5/186<br>415/115 |
| 2014/0056719 | A1* | 2/2014 | Morisaki | F01D 5/186<br>416/97 R |

FOREIGN PATENT DOCUMENTS

| | | | |
|---|---|---|---|
| EP | 1600605 | A2 | 11/2005 |
| JP | 2007-218257 | A | 8/2007 |
| WO | 2011160930 | A1 | 12/2011 |

OTHER PUBLICATIONS

Japanese Office Action dated Jan. 26, 2016 in corresponding Japanese Patent Application No. 2015-004768.
Extended European Search Report dated Jun. 25, 2015 in corresponding European patent application No. 15151296.9-1610.
Chinese Office Action dated Nov. 25, 2015 in corresponding Chinese patent application No. 201510002234.4.

* cited by examiner

RELATED ART

TURBINE BLADE HAVING SWIRLING COOLING CHANNEL AND COOLING METHOD THEREOF

CROSS-REFERENCE TO RELATED APPLICATIONS

This application claims priority to Korean Patent Application No. 10-2014-0005586, filed on Jan. 16, 2014, the disclosure of which is incorporated herein by reference in its entirety.

BACKGROUND

Exemplary embodiments of the present disclosure relate to a turbine blade, and more particularly, to a turbine blade including a cooling channel through which cooling air is passed and a swirl portion provided at an entrance of the cooling channel so as to form a swirl flow for cooling air.

In general, a gas turbine refers to a kind of internal combustion engine which mixes fuel with air compressed at high pressure by a compressor, burns the mixture to generate high-temperature and high-pressure combustion gas, and injects the combustion gas to rotate a turbine. That is, the gas turbine converts thermal energy into mechanical energy.

In order to construct such a turbine, a plurality of turbine rotor disks each having a plurality of turbine blades arranged on the outer circumferential surface thereof may be configured in multiple stages such that the high-temperature and high-pressure combustion gas passes through the turbine blades.

Gas turbines have been increasing in size and efficiency leading to an increase in temperature of a combustor outlet. A turbine blade cooing unit is commonly employed to withstand high-temperature combustion gas.

In particular, a structure may have a cooling channel through which cooling air of a turbine blade can be passed. The structure passes compressed air extracted from the compressor rotor to the cooling channel, in order to utilize the compressed air as cooling air.

As illustrated in FIG. 1, the turbine blade 10 includes a root unit 1, a blade unit 2 having a leading edge 4 and a trailing edge 5, and a platform unit 3 provided between the root unit 1 and the blade unit 2. The blade unit 2 has a plurality of cooling channels 7 formed therein, and the plurality of cooling channels 7 communicate with a cooling air entrance 9 and are divided through a plurality of partitions 6. Each of the cooling channels 7 has a plurality of turbulators 8 to generate turbulence in the cooling air flowing therein.

However, the turbine blade 10 is limited to the turbulators 8 for increasing heat transfer efficiency in the blade unit 2, and cooling units for the root unit 1.

That is, since the weight of the blade unit 2 rotating at high speed concentrates on the root unit 1, the root unit 1 is required to have a high level of strength.

When the gas turbine is driven, a considerable amount of heat is continuously transferred to the platform unit 3 and the root unit 1 through the blade unit 2 exposed to the high-temperature combustion gas. Thus, as illustrated in FIG. 1, when cooling units suitable for the platform unit 3 and the root unit 1 are not provided, the strength of the root unit 1 decreases to a significantly low level. As a result, the root unit 1 may be damaged.

BRIEF SUMMARY

The present disclosure has been made in view of the above problems, and it is an object of the present disclosure to provide a turbine blade which includes a swirl portion provided at a cooling channel entrance through which cooling air is passed, thereby increasing the cooling performance of a root unit and significantly improving the stiffness of the root unit.

Also, it is another object of the present disclosure to provide a turbine blade which includes a swirl portion provided at a cooling channel entrance through which cooling air is passed, thereby significantly increasing the heat transfer efficiency of a blade unit.

Other objects and advantages of the present disclosure can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present disclosure, a turbine blade may include: a root unit; a blade unit having a leading edge and a trailing edge; and a platform unit provided between the blade unit and the root unit. The blade unit may include a cooling channel formed therein, through which a cooling air is passed. The root unit may include an entrance formed therein communicating with the cooling channel, and the entrance may include a swirl portion through which the cooling air forms a swirl flow while flowing in a longitudinal direction of the blade unit.

The cooling channel may include a first cooling channel formed adjacent to the leading edge and extended in the longitudinal direction of the blade unit and a second cooling channel formed between the first cooling channel and the trailing edge and extended in the longitudinal direction. The entrance may include a first entrance communicating with the first cooling channel and a second entrance communicating with the second cooling channel, and the swirl portion may include a first swirl portion provided at the first entrance and a second swirl portion provided at the second entrance.

The first swirl portion may include a plurality of first guide ribs protruding from an inner circumferential surface of the first entrance and extended in the longitudinal direction while forming a first inclination angle with respect to the longitudinal direction. The second swirl portion may include a plurality of second guide ribs protruding from an inner circumferential surface of the second entrance and extended in the longitudinal direction while forming a second inclination angle with respect to the longitudinal direction.

The first guide ribs and the second guide ribs may be extended in a straight line shape in the longitudinal direction.

The first guide ribs and the second guide ribs may be extended in a curved line shape in the longitudinal direction.

The first and second inclination angles may be different from each other, or the first inclination angle may be larger than the second inclination angle.

An interval between the plurality of first guide ribs may be different from an interval between the plurality of second guide ribs, or the interval between the plurality of first guide ribs may be smaller than the interval between the plurality of second guide ribs.

A number of the plurality of first guide ribs may be different from a number of the plurality of second guide ribs, or the number of the plurality of first guide ribs may be larger than the number of the plurality of second guide ribs.

A protrusion height of the plurality of first guide ribs from the inner circumferential surface of the first entrance may be different from a protrusion height of the plurality of second guide ribs from the inner circumferential surface of the second entrance, or the protrusion height of the plurality of first guide ribs from the inner circumferential surface of the first entrance may be larger than the protrusion height of the plurality of second guide ribs from the inner circumferential surface of the second entrance.

A cross-sectional area of the first entrance in a direction perpendicular to the longitudinal direction may be different from a cross-sectional area of the second entrance in the direction perpendicular to the longitudinal direction, or the cross-sectional area of the first entrance in the direction perpendicular to the longitudinal direction may be larger than the cross-sectional area of the second entrance in the direction perpendicular to the longitudinal direction.

In accordance with another aspect of the present disclosure, there is provided a cooling method of a turbine blade which includes a root unit, a blade unit having a leading edge and a trailing edge, and a platform unit provided between the blade unit and the root unit, wherein a cooling channel through which cooing air is passed in the blade unit is formed in a longitudinal direction of the blade unit. The cooling method may include: supplying a cooling air to an entrance provided at the root unit and communicating with the cooling channel; and generating a swirl flow in the cooling air passing through the entrance, using a swirl portion provided at the entrance.

The supplying of the cooling air to the entrance may include: supplying the cooling air to a first entrance communicating with a first cooling channel which is formed adjacent to the leading edge and extended in the longitudinal direction of the blade unit; and supplying cooling air to a second entrance communicating with a second cooling channel which is formed between the first cooling channel and the trailing edge and extended in the longitudinal direction.

The generating of the swirl flow using the swirl portion in the cooling air may include: generating a swirl flow using a first swirl portion provided at the first entrance; and generating a swirl flow using a second swirl portion provided at the second entrance.

The generating of the swirl flow using the first swirl portion may include generating a swirl flow in the cooling air using a plurality of first guide ribs protruding from an inner circumferential surface of the first entrance. The generating of the swirl flow using the second swirl portion may include generating a swirl flow in the cooling air using a plurality of guide ribs protruding from an inner circumferential surface of the second entrance. The plurality of second guide ribs may be extended in the longitudinal direction while forming a first inclination angle with respect to the longitudinal direction, and the plurality of second guide ribs may be extended in the longitudinal direction while forming a second inclination angle with respect to the longitudinal direction.

It is to be understood that both the foregoing general description and the following detailed description of the present disclosure are exemplary and explanatory and are intended to provide further explanation of the invention as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
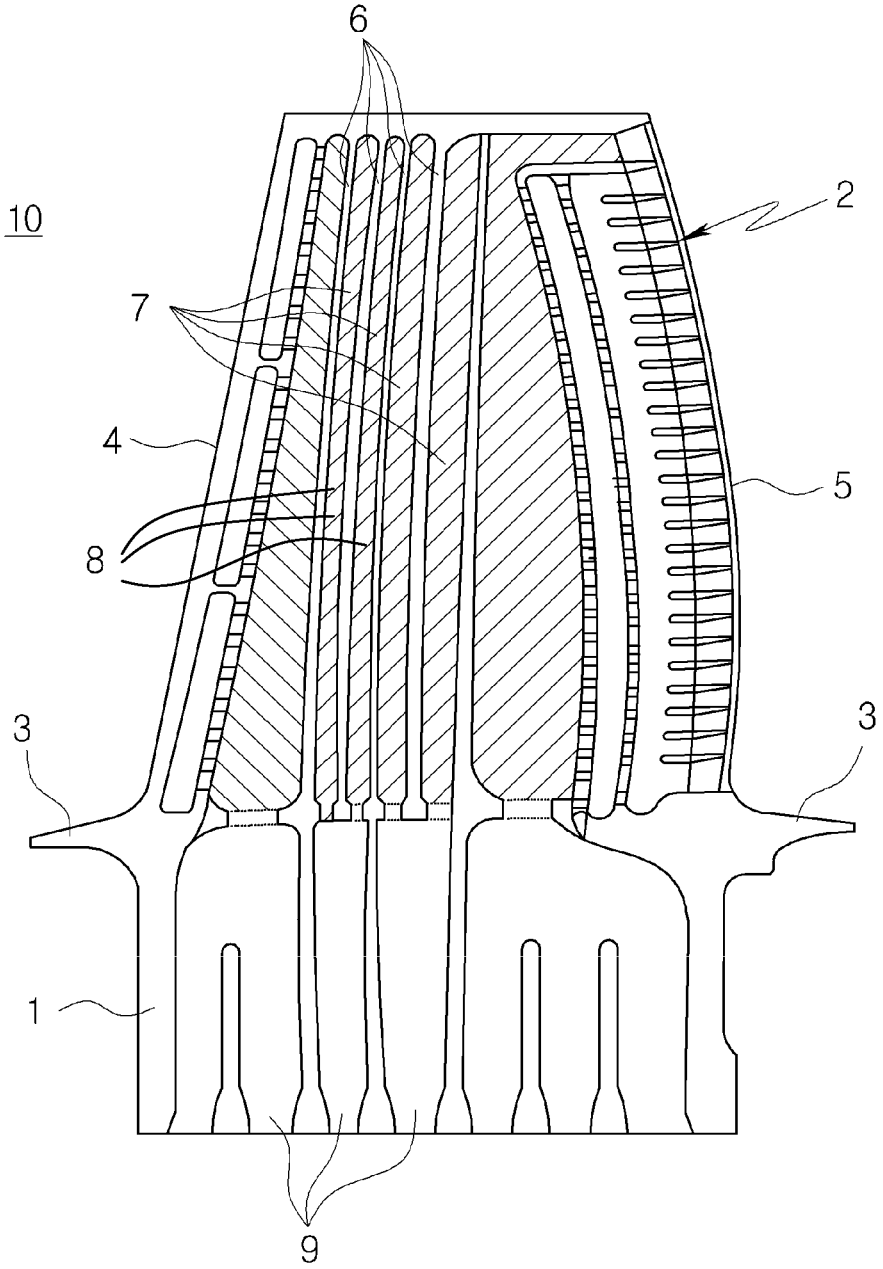
FIG. 1 is a cross-sectional view of a turbine blade according to the related art.

Hereafter, embodiments of the present disclosure will be described with reference to the accompanying drawings.

The present disclosure may include various modifications and various embodiments, and thus specific embodiments will be illustrated in the drawings and described in the detailed descriptions. However, the present disclosure is not limited to specific embodiments, and may include all of variations, equivalents, and substitutes within the scope of the present disclosure.

When the embodiments of the present disclosure are described, terms such as first and second may be used to described various elements, but the embodiments are not limited to the terms. The terms are used only to distinguish one element from another element. For example, a first element may be referred to as a second element, without departing from the scope of the present invention. Similarly, a second element may be referred to as a first element.

When an element is referred to as being connected or coupled to another element, it should be understood that the former can be directly connected or coupled to the latter, or connected or coupled to the latter via an intervening element therebetween. On the other hand, when an element is referred to as being directly connected to another element, it may be understood that no intervening element exists therebetween.

The terms used in this specification are used only to describe specific embodiments, but do not limit the present invention. The terms of a singular form may include plural forms unless referred to the contrary. The terms of a singular form may include plural forms unless referred to the contrary.

In this specification, the meaning of include or comprise specifies a property, a number, a step, a process, an element, a component, or a combination thereof, but does not exclude one or more other properties, numbers, steps, processes, elements, components, or combinations thereof.

The terms including technical or scientific terms have the same meanings as the terms which are generally understood by those skilled in the art to which the present disclosure pertains, as long as they are differently defined. The terms defined in a generally used dictionary may be analyzed to have meanings which coincide with contextual meanings in the related art. As long as the terms are not clearly defined in this specification, the terms may not be analyzed as ideal or excessively formal meanings.

Furthermore, the following embodiments are provided for clear understanding of those skilled in the art, and the shapes and sizes of components in the drawings are exaggerated for clarity of description.

Figure 2:
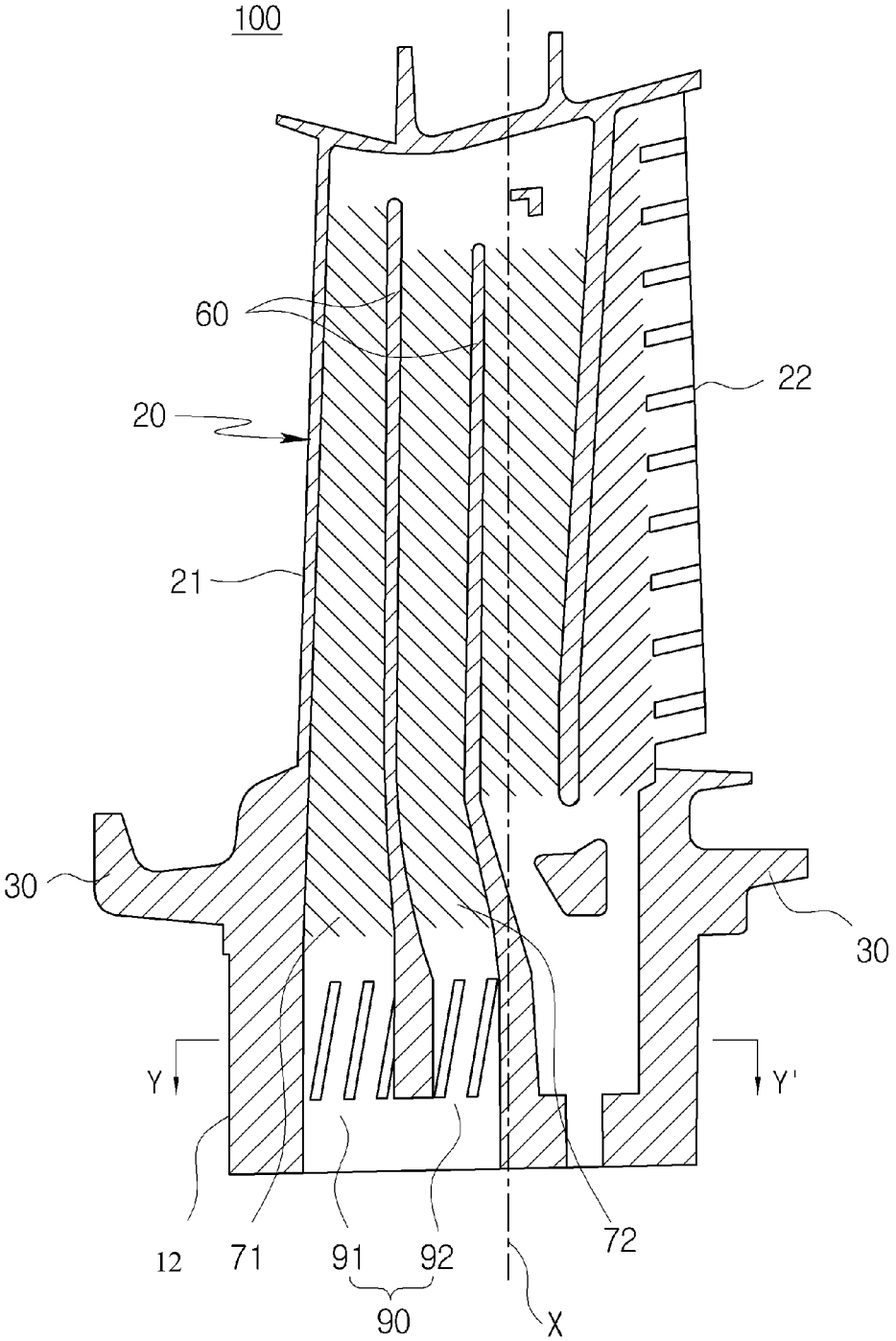
FIG. 2 is a longitudinal cross-sectional view of a turbine blade with a swirl portion according to a first embodiment of the present disclosure.
Figure 3:
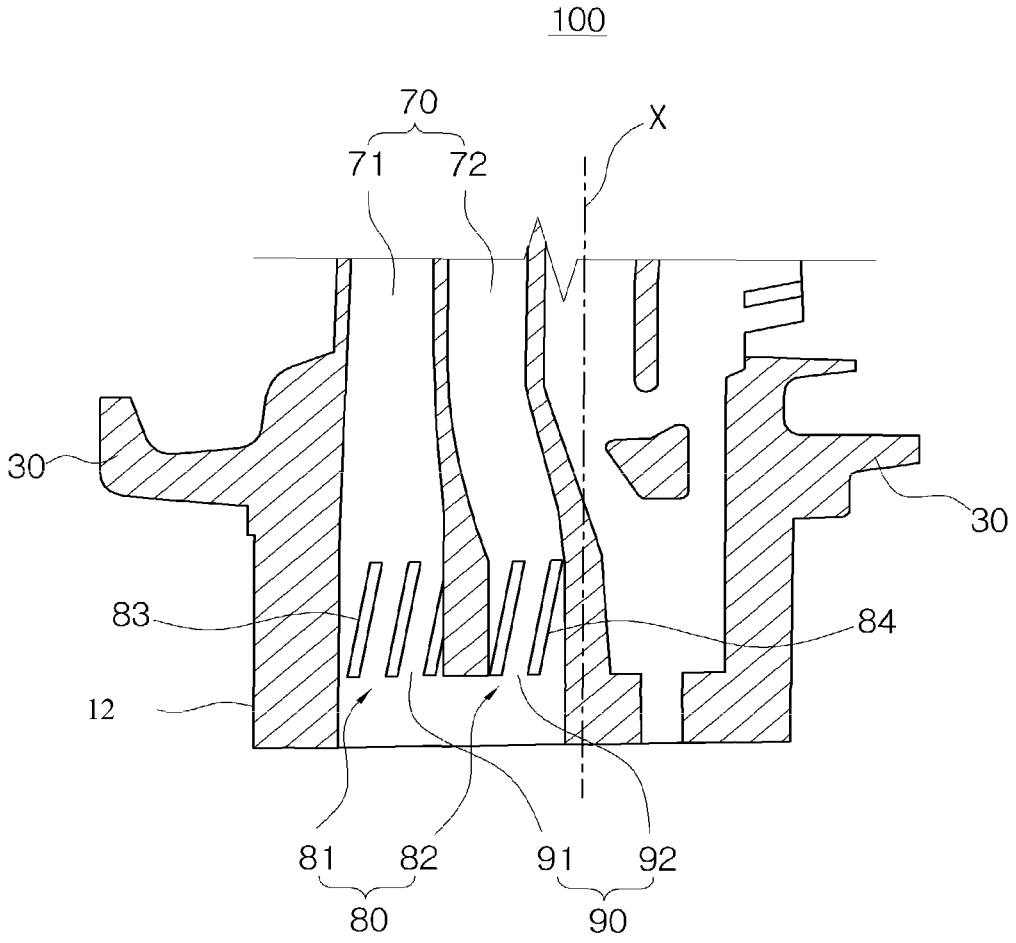
FIG. 3 is a partially expanded view of the turbine blade illustrated in FIG. 2.

FIG. 2 is a longitudinal cross-sectional view of a turbine blade 100 with a swirl portion 80 (see also FIG. 3) according to a first embodiment of the present disclosure. FIG. 3 is a partially expanded view of the turbine blade 100 illustrated in FIG. 2.

Referring to FIGS. 2 and 3, the turbine blade 100 according to the embodiment of the present disclosure includes a root unit 12, a blade unit 20 having a leading edge 21 and a trailing edge 22, and a platform unit 30 provided between the blade unit 20 and the root unit 12. The blade unit 20 has a cooling channel 70 formed therein, through which cooling air is passed. The cooling channel 70 includes a first cooling channel 71 formed adjacent to the leading edge 21 and extended in the longitudinal direction of the blade unit 20 and a second cooling channel 72 formed between the first cooling channel 71 and the trailing edge 22 and extended in the longitudinal direction. The root unit 12 or the platform unit 30 includes first and second entrances 91 and 92 formed therein. The entrance 91 communicates with the first cooling channel 71, and the second entrance 92 communicates with the second cooling channel 72. The first entrance 91 includes a first swirl portion 81 through which cooling air passing through the first entrance 91 forms a swirl flow while flowing in the longitudinal direction, and the second entrance 92 includes a second swirl portion 82 through which cooling air passing through the second entrance 92 forms a swirl flow while flowing in the longitudinal direction.

That is, in the turbine blade 100 according the embodiment of the present disclosure, the inside of the blade unit 20 is divided into the plurality of cooling channels 70 through a plurality of partitions 60, in order to utilize compressed air extracted from a compressor (not illustrated) as cooling air. More specifically, the inside of the blade unit 20 may be divided into at least the first and second cooling channels 71 and 72 through which the cooling air is passed. The first and second cooling channels 71 and 72 may include a plurality of turbulators for generating a swirl flow in cooling air flowing therein. The plurality of turbulators are indicated by oblique lines in each of the cooling channels of FIG. 2.

Furthermore, in order to not only increase the internal heat transfer efficiency of the blade unit 20 through the cooling air introduced to the cooling channel 70, but also improve the cooling performance of the root unit 12, the swirl portion 80 is provided at the entrance 90 of the cooling channel 70 such that cooling air introduced into the entrance 90 forms a more uniform swirl flow while flowing in the longitudinal direction of the blade unit 20.

The entrance 90 may be divided into a first entrance 91 communicating with the first cooling channel 71 and a second entrance 92 communicating with the second cooling channel 72. A first swirl portion 81 is provided at the first entrance 91 such that the cooling air passing through the first entrance 91 forms a swirl flow while flowing in the longitudinal direction, and a second swirl portion 82 is provided at the second entrance 92 such that the cooling air passing through the second entrance 92 forms a swirl flow while flowing in the longitudinal direction.

The swirl portion 80 may include guide ribs serving as a structure for forming a more uniform swirl flow in the introduced cooling air. More specifically, the first and second swirl portions 81 and 82 may include guide ribs 83 and 84, respectively, which protrude from the inner circumferential surfaces of the first and second entrances 91 and 92 and are extended in the upward direction, that is, the longitudinal direction of the blade unit 20, while forming a predetermined inclination angle with respect to the longitudinal axis X of the blade unit 20. The first guide rib 83 provided at the first entrance 91 and the second guide rib 84 provided at the second entrance 92 may have the same shape or different structures as described below.

Figure 4:
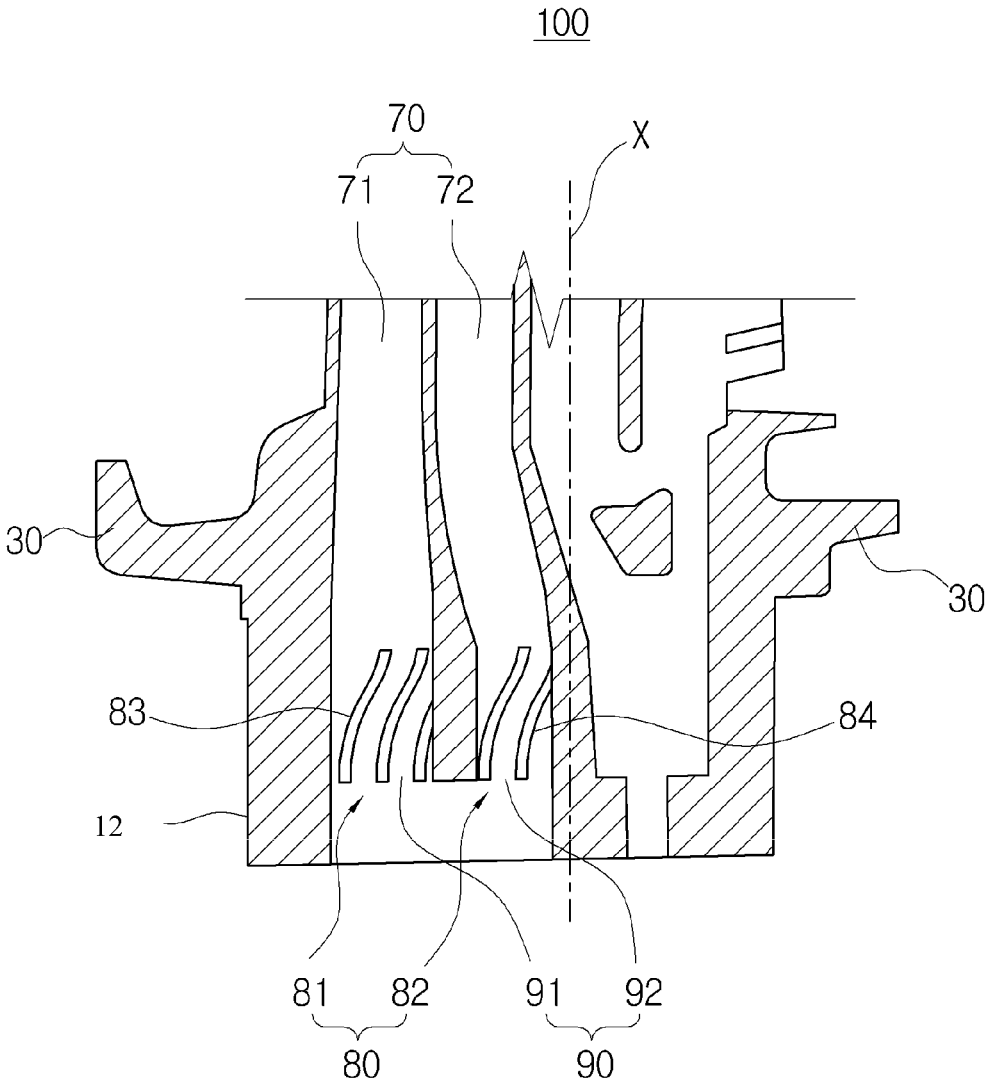
FIG. 4 is a partially expanded view of a turbine blade with a swirl portion according to a second embodiment of the present disclosure.

The shapes of the first and second guide ribs 83 and 84 according to the embodiment of the present disclosure are not limited, but any structures may be applied as the first and second guide ribs 83 and 84 as long as they can improve the cooling performance of the root unit 12 and increase the internal heat transfer efficiency of the cooling channel 70 by forming a uniform swirl flow in cooling air introduced into the cooling air entrance 90. Desirably, in order to simplify the structure of the cooling air entrance 90, the first and second guide ribs 83 and 84 may be formed to protrude from the inner circumferential surface of the cooling air entrance 90 and continuously extended in a straight line shape toward the cooling channels 71 and 72, as described in the first embodiment illustrated in FIG. 3. Alternatively, the first and second guide ribs 83 and 84 may be continuously extended in a curved line shape toward the cooling channels 71 and 72, as described in the second embodiment illustrated in FIG. 4.

Now, a cooling process of the turbine blade 100 according to the embodiment of the present disclosure, based on a flow of cooling air, will be described as follows. First, cooling air is introduced into the root unit 12 through a cooling channel of a turbine rotor (not illustrated). The cooling channel of the turbine rotor, through which the cooling air is supplied into the turbine blade 100, may be applied to the present disclosure without being limited thereto as other structures and methods of providing the cooling air to the turbine blade 100 may also be used.

Then, the cooling air introduced into the root unit 12 is supplied to the entrance 90 communicating with the cooling channel 70 formed in the blade unit 20. More specifically, as illustrated in FIGS. 2 and 3, the cooling air introduced into the root unit 12 is supplied to the first entrance 91 communicating with the first cooling channel 71 and supplied to the second entrance 92 communicating with the second cooling channel 72, which may be isolated from the first cooling channel 71 by the partition 60.

Then, the cooling air introduced into the first entrance 91 forms a swirl flow while passing through the first swirl portion 81 provided at the first entrance 91, and the cooling air introduced into the second entrance 92 forms a swirl flow while passing through the second swirl portion 82. As such, the cooling air which forms swirl flows through the first and second swirl portions 81 and 82 may effectively absorb heat from the entrances 91 and 92 while passing through the entrances 91 and 92, thereby significantly increasing the cooling efficiency of the root unit 12.

Then, the cooling air which forms a swirl flow while passing through the first entrance 91 flows through the first cooling channel 71, and the cooling air which forms a swirl flow while passing through the second entrance 92 flows through the second cooling channel 72. At this time, since each of the first and second cooling channels 71 and 72 includes the plurality of turbulators formed therein as described above, the strength of the swirl flows which are formed while the cooling air passes through the first and second entrances 91 and 92 may be further increased through the turbulators. Thus, the cooling performance of the blade unit 20 may be significantly improved.

Figure 5:
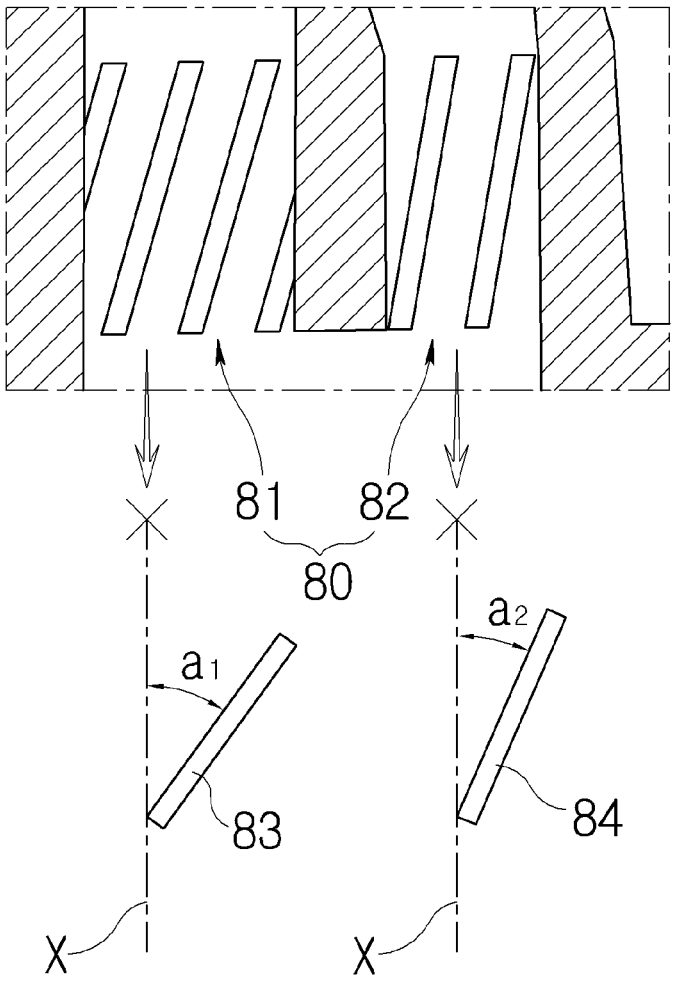
FIG. 5 is a partially expanded view of a turbine blade with a swirl portion according to a third embodiment of the present disclosure.

FIG. 5 is a partially expanded view of a turbine blade 100 with a swirl portion 80 according to a third embodiment of the present disclosure.

Referring to FIG. 5, the swirl portion 80 according to the third embodiment of the present disclosure includes a first swirl portion 81 provided at a first entrance 91 and a second swirl portion 82 provided at a second entrance 92. The first swirl portion 82 includes a plurality of first guide ribs 83 which are formed to protrude from the inner circumferential surface of the first entrance 91 and extend in the upward direction or the longitudinal direction of the blade unit 20 while forming a first inclination angle a1 with respect to the longitudinal direction. The second swirl portion 83 includes a plurality of second guide ribs 84 which are formed to protrude from the inner circumferential surface of the second entrance 92 and extend in the upward direction or the longitudinal direction of the blade unit 20 while forming a second inclination angle a2 with respect to the longitudinal direction. The first and second inclination angles a1 and a2 are set to be different from each other. More desirably, the first inclination angle a1 may be set to be larger than the second inclination angle a2.

The first and second swirl portions 81 and 82 according to the embodiment of the present disclosure may have different structures from each other as described above.

In the first cooling channel 71 which is formed adjacent to the leading edge 21 of the blade unit 20 a stronger swirl flow has a higher heat transfer efficiency for cooling air flowing through the first cooling channel 71. For this structure, the strength of a swirl flow generated through the first swirl portion 81 provided at the first entrance 91 of the first cooling channel 71 may be set to be different from the strength of a swirl flow generated through the second swirl portion 82 provided at the second entrance 91 of the second cooling channel 72.

Thus, as illustrated in FIG. 5, a first inclination angle a1 formed between the first guide rib 83 and the longitudinal axis X may be set to be different from a second inclination angle a2 formed between the second guide rib 84 and the longitudinal axis X, in order to increase the strength of a swirl flow generated through the first guide rib 83. More desirably, the first inclination angle a1 may be set to be larger than the second inclination angle a2.

Figure 6:
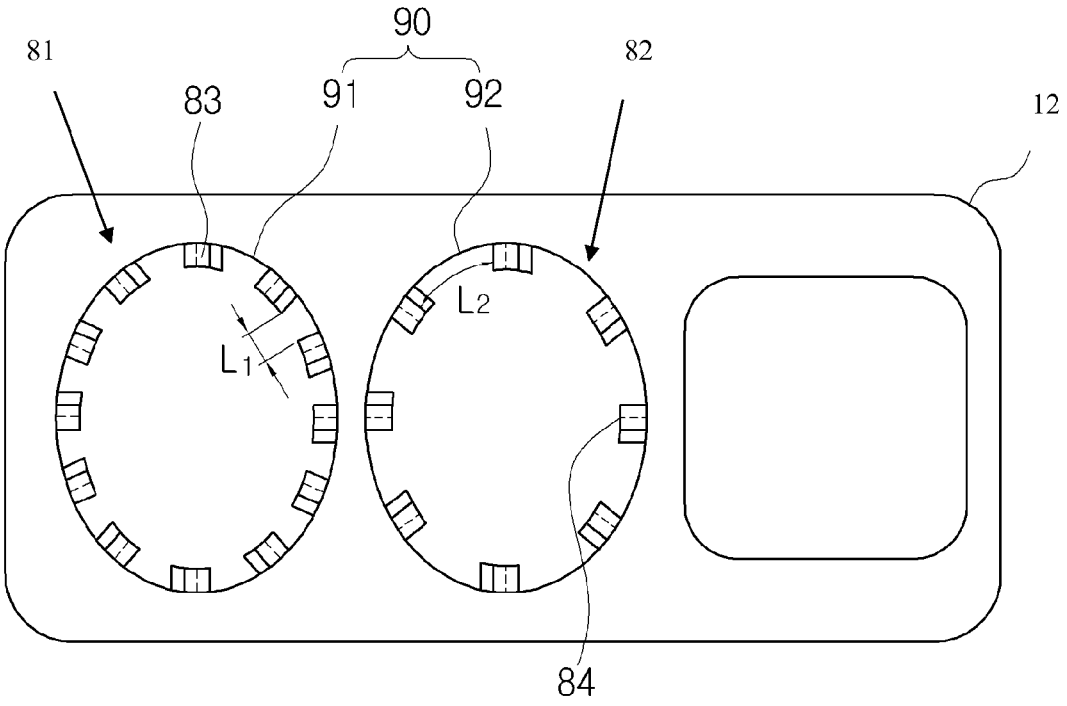
FIG. 6 is a cross-sectional view of a cooling air entrance of a turbine blade with a swirl part according to a fourth embodiment of the present disclosure.
Figure 7:
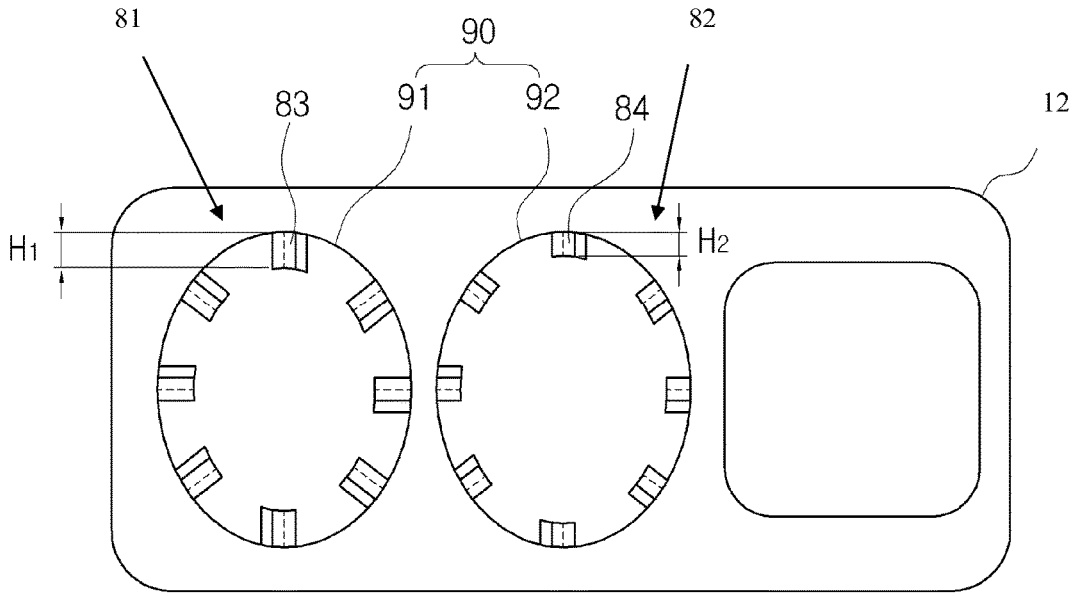
FIG. 7 is a cross-sectional view of a cooling air entrance of a turbine blade with a swirl part according to a fifth embodiment of the present disclosure.

FIGS. 6 and 7 are cross-sectional views of cooling air entrances of turbine blades with a swirl portion 80 according to fourth and fifth embodiments of the present disclosure, illustrating first and second swirl portions 81 and 82 having different structures from each other.

Referring to FIG. 6, the swirl portion 80 according to the fourth embodiment of the present disclosure may include a first swirl portion 81 provided at a first entrance and a second swirl portion 82 provided at a second entrance, and the number of first guide ribs 83 formed in the first swirl portion 81 may be set to be different from the number of second guide ribs 84 formed in the second swirl portion 82. Desirably, the number of first guide ribs 83 may be set to be larger than the number of second guide ribs 84.

As the number of first guide ribs 83 formed in the first swirl portion 81 may be set to be different from the number of second guide ribs 84 formed in the second swirl portion 82, it is possible to adjust the strength of a swirl flow generated through the first swirl portion 81 and the strength of a swirl flow generated through the second swirl portion 82. Desirably, in order to achieve a higher heat transfer effect, the number of first guide ribs 83 may be set to be larger than the number of second guide ribs 84.

In the example of FIG. 6, the first swirl portion 81 has 12 first guide ribs 83, and the second swirl portion 82 has eight second guide ribs 84. However, the present disclosure is not limited to specific numbers of guide ribs. In order to adjust the strengths of swirl flows generated through the first and second swirl portions 81 and 82, the number of the first guide ribs 83 and the number of the second guide ribs 84 may be combined in various manners. Such a modification also belongs to the scope of the present disclosure.

Furthermore, in order to adjust the strengths of swirl flows generated through the first and second swirl portions 81 and 82, an interval between the first guide ribs 83 formed in the first swirl portion 81 may be set to be different from an interval between the second guide ribs 84 formed in the second swirl portion 82. Desirably, the interval between the first guide ribs 83 may be set to be smaller than the interval between the second guide ribs 84.

FIG. 6 illustrates an example in which the interval L1 between the first guide ribs 83 is different from the interval L2 between the second guide ribs 84. More specifically, the interval L1 between the first guide ribs 83 is set to be smaller than the interval L2 between the second guide ribs 84.

FIG. 7 illustrates another structure for adjusting the strengths of swirl flow generated through the first and second swirl portions 81 and 82. Referring to FIG. 7, the protrusion height of the first guide rib 83 from the inner circumferential surface of the first entrance 91 is set to be different from the protrusion height of the second guide rib 84 from the inner circumferential surface of the second entrance 92.

Referring to FIG. 7, as the height H1 of the first guide rib 83 protruding from the inner circumferential surface of the first entrance 91 is set to be different from the height H2 of the second guide rib 84 protruding from the inner circumferential surface of the second entrance 92, the strength of the swirl flow generated through the first swirl portion 81 may be set to be different from the strength of the swirl flow generated through the second swirl portion 82.

In this case, the protrusion height H1 of the first guide rib 83 may be set to be larger than the protrusion height H2 of the second guide rib 84, in order to increase the strength of the swirl flow generated through the first swirl portion 81.

In addition, a structure for introducing a larger flow rate of cooling air into the first cooling channel 71 which requires higher heat transfer efficiency may also be considered.

Figure 8:
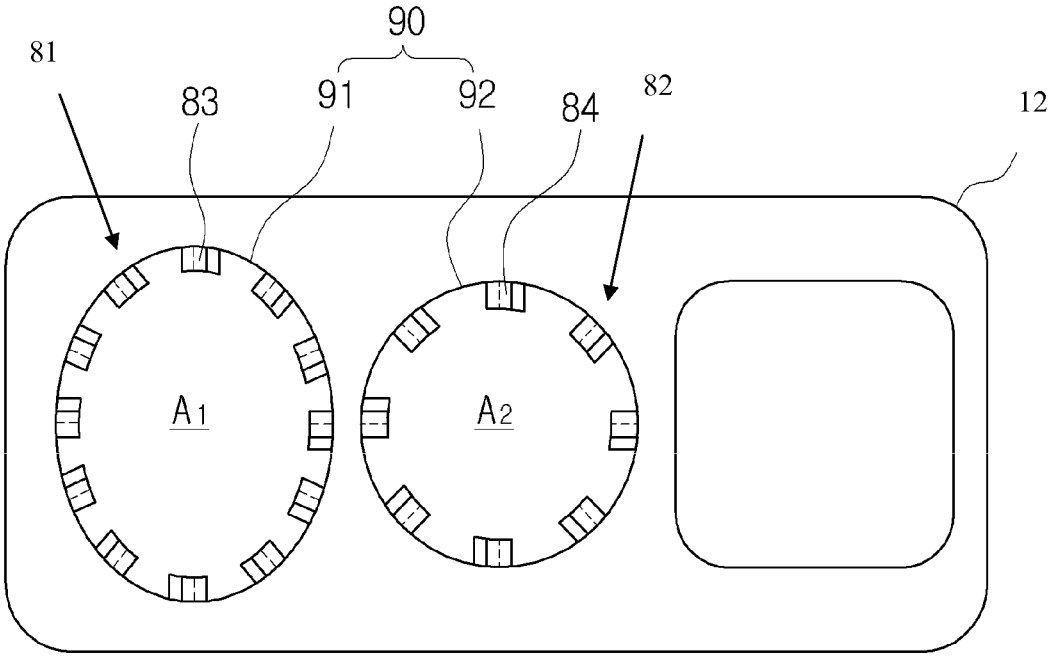
FIG. 8 is a cross-sectional view of a turbine blade with cooling air entrances having different cross-sectional areas according to a sixth embodiment of the present disclosure.

For this structure, as illustrated in FIG. 8 according to a sixth embodiment of the present disclosure, the cross-sectional area A1 of the first entrance 91 in a direction perpendicular to the longitudinal direction of the blade unit 20 may be set to be different from the cross-sectional area A2 of the second entrance 92 in a direction perpendicular to the longitudinal direction. Desirably, as the cross-sectional area A1 of the first entrance 91 is set to be larger than the cross-sectional area A2 of the second entrance 92, the flow rate of cooling air introduced into the first cooling channel 71 may be set to be larger than the flow rate of cooling air introduced into the second cooling channel 72.

FIG. 8 illustrates that the first guide ribs 83 provided at the first entrance 91 and the second guide ribs 84 provided at the second entrance 92 have the same shape and structure. However, while the cross-sectional area A1 of the first entrance 91 and the cross-sectional area A2 of the second entrance 92 are set to be different from each other, the structure of the first swirl portion 81 and the structure of the second swirl portion 82 may be set to be different from each other according to the above-described embodiments. This structure also belongs to the scope of the present disclosure.

Furthermore, FIGS. 6 to 8 illustrate that the first and second entrances 91 and 92 in the direction perpendicular to the longitudinal direction of the blade unit 20 have a circular or elliptical cross-sectional shape. However, this is only an example, and the first and second entrances 91 and 92 may have a different cross-sectional shape. This structure also belongs to the scope of the present disclosure.

According to the embodiments of the present disclosure, the turbine blade may include the swirl portion provided at the cooling channel entrance through which cooling air is passed, thereby increasing the cooling performance and significantly improving the stiffness of the root unit.

Furthermore, the turbine blade may include a swirl portion provided at the cooling channel entrance through which cooling air is passed, thereby significantly increasing the internal heat transfer efficiency of the blade unit.

While the present disclosure has been particularly shown and described with reference to exemplary embodiments thereof, it will be understood by those of ordinary skill in the art that various changes and modifications may be made therein without departing from the technical idea and scope of the present disclosure and such changes and modifications belong to the claims of the present disclosure. Further, the embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

What is claimed is:

1. A turbine blade, comprising:

a blade unit having a leading edge, a trailing edge, and a cooling channel to pass cooling air there through, the cooling channel including a first channel defined in the blade unit adjacent to the leading edge and extending in a longitudinal direction of the blade unit, and a second channel defined in the blade unit between the first channel and the trailing edge and extending in the longitudinal direction;

a root unit including an air entrance, the air entrance including a first entrance communicating with the first channel, the first entrance having a first swirl portion to provide a swirl flow of air in the longitudinal direction along the first channel, and a second entrance communicating with the second channel, the second entrance having a second swirl portion to provide a swirl flow of air in the longitudinal direction along the second channel; and a platform unit disposed between the blade unit and the root unit.

2. The turbine blade according to claim 1, wherein the first swirl portion includes a plurality of first guide ribs protruding from an inner circumferential surface of the first entrance, the first guide ribs extending in the longitudinal direction at a first inclination angle with respect to the longitudinal direction, and the second swirl portion includes a plurality of second guide ribs protruding from an inner circumferential surface of the second entrance, the second guide ribs extending in the longitudinal direction at a second inclination angle with respect to the longitudinal direction.

3. The turbine blade according to claim 2, wherein the first guide ribs and the second guide ribs extend in a straight line shape in the longitudinal direction.

4. The turbine blade according to claim 2, wherein the first guide ribs and the second guide ribs extend in a curved line shape.

5. The turbine blade according to claim 2, wherein the first inclination angle of the plurality of first guide ribs is different than the second inclination angle of the plurality of second guide ribs.

6. The turbine blade according to claim 5, wherein the first inclination angle is larger than the second inclination angle.

7. The turbine blade according to claim 2, wherein an interval between two of the plurality of first guide ribs is different than an interval between two of the plurality of second guide ribs.

8. The turbine blade according to claim 7, wherein the interval between the two of the plurality of first guide ribs is smaller than the interval between the two of the plurality of second guide ribs.

9. The turbine blade according to claim 2, wherein a number of the plurality of first guide ribs is different from a number of the plurality of second guide ribs.

10. The turbine blade according to claim 9, wherein the number of the plurality of first guide ribs is larger than the number of the plurality of second guide ribs.

11. The turbine blade according to claim 2, wherein a protrusion height of one of the plurality of first guide ribs from the inner circumferential surface of the first entrance is different from a protrusion height of one of the plurality of second guide ribs from the inner circumferential surface of the second entrance.

12. The turbine blade according to claim 11, wherein the protrusion height of the one of the plurality of first guide ribs is larger than the protrusion height of the one of the plurality of second guide ribs.

13. The turbine blade according to claim 1, wherein a cross-sectional area of the first entrance in a direction perpendicular to the longitudinal direction is different from a cross-sectional area of the second entrance in the direction perpendicular to the longitudinal direction.

14. The turbine blade according to claim 13, wherein the cross-sectional area of the first entrance is larger than the cross-sectional area of the second entrance.

15. A cooling method of a turbine blade which includes a blade unit having a leading edge, a trailing edge, a root unit, and a platform unit disposed between the blade unit and the root unit, a cooling channel having a first channel and a second channel extending in a longitudinal direction of the blade unit through which cooling air passes, the cooling method comprising:

supplying the cooling air to an air entrance of the root unit that communicates with the cooling channel, the air entrance including a first entrance communicating with the first channel defined adjacent the leading edge and a second entrance communicating with the second channel defined between the first channel and the trailing edge; and generating a first swirl flow of the cooling air through the first channel via a first swirl portion formed in the first entrance and a second swirl flow of the cooling air through the second channel via a second swirl portion formed in the second entrance.

16. The cooling method according to claim 15, wherein the first swirl flow of the cooling air is generated by a plurality of first guide ribs protruding from an inner circumferential surface of the first entrance, and the second swirl flow of the cooling air is generated by a plurality of second guide ribs protruding from an inner circumferential surface of the second entrance, the plurality of first guide ribs extending in the longitudinal direction at a first inclination angle with respect to the longitudinal direction, and the plurality of second guide ribs extending in the longitudinal direction at a second inclination angle with respect to the longitudinal direction.

17. The cooling method according to claim 16, wherein the first inclination angle of the plurality of first guide ribs is different than the second inclination angle of the plurality of second guide ribs.

18. The cooling method according to claim 16, wherein an interval between two of the plurality of first guide ribs is different than an interval between two of the plurality of second guide ribs.

19. The cooling method according to claim 16, wherein a number of the plurality of first guide ribs is different from a number of the plurality of second guide ribs.

20. The cooling method according to claim 16, wherein a protrusion height of one of the plurality of first guide ribs from the inner circumferential surface of the first entrance is different from a protrusion height of one of the plurality of second guide ribs from the inner circumferential surface of the second entrance.

* * * * *